United States Patent [19]

Segerstrom et al.

[11] Patent Number: 4,852,997

[45] Date of Patent: Aug. 1, 1989

[54] SLAG WATER BATH PROCESS

[75] Inventors: Clifford C. Segerstrom; Charles V. Sternling, both of Houston, Tex.; Hans-Wolfgang Lüke, Hamburg, Fed. Rep. of Germany; Hsi L. Wu, The Hague, Netherlands

[73] Assignee: Shell Oil Company, Houston, Tex.

[21] Appl. No.: 104,467

[22] Filed: Oct. 5, 1987

[51] Int. Cl.[4] ..... C10J 3/72

[52] U.S. Cl. ..... 48/210; 48/DIG. 2; 48/69

[58] Field of Search ..... 48/197 R, 203, 206, 48/210, DIG. 2, 69; 110/344, 347, 165 R, 171; 75/0.5 R; 252/373

[56] References Cited

U.S. PATENT DOCUMENTS

| | | | |
|---|---|---|---|
| 3,253,906 | 5/1966 | Secord | 75/40 |
| 4,073,627 | 2/1978 | Anderson | 48/62 R |
| 4,073,629 | 2/1978 | Funk | 48/77 |
| 4,119,411 | 10/1978 | Anderson et al. | 48/62 R |
| 4,126,427 | 11/1978 | Eales | 48/62 R |
| 4,129,422 | 12/1978 | Wood | 48/77 |
| 4,177,042 | 12/1979 | Wood | 48/87 |
| 4,192,654 | 3/1980 | Brooks | 48/77 |
| 4,195,978 | 4/1980 | Anderson | 48/62 R |
| 4,247,302 | 1/1981 | Woldy et al. | 48/197 R |
| 4,289,502 | 9/1981 | Muenger et al. | 48/62 R |
| 4,328,006 | 5/1982 | Muenger et al. | 48/62 R |
| 4,343,625 | 8/1982 | Gates et al. | 48/62 R |
| 4,367,076 | 1/1983 | Peise et al. | 48/69 |
| 4,377,394 | 3/1983 | Muenger et al. | 48/62 R |
| 4,465,496 | 8/1984 | Suggitt | 48/197 R |
| 4,472,171 | 9/1984 | Broderick | 48/DIG. 2 |
| 4,487,612 | 12/1984 | Hebden et al. | 48/77 |
| 4,514,191 | 4/1985 | Langhoff et al. | 48/77 |
| 4,533,363 | 8/1985 | Jahnke et al. | 48/197 R |
| 4,541,840 | 9/1985 | Hibbel et al. | 48/63 |
| 4,707,163 | 11/1987 | Gudymov et al. | 48/69 |

FOREIGN PATENT DOCUMENTS

| | | | |
|---|---|---|---|
| 2135434 | 8/1984 | United Kingdom | 48/203 |

OTHER PUBLICATIONS

EPRI Report, AP-3129, (1983), Hartman et al., p. 7—7.
Hydrocarbon Processing, (1984), vol. 63, No. 4, p. 96.
EPRI AP-4680, "Proceedings, 5th Annual . . . Conference on Coal Gasification", 1985, pp. 7-6, 7-15.

*Primary Examiner*—Peter Kratz

[57] ABSTRACT

A method and apparatus for separating slag discharged from a coal gasification reactor to a slag water bath by converging the flow of the slag with a chamber at least partially submerged in the slag water bath such that the flow of slag is converged to a diameter no greater than the diameter of the discharge opening of the slag water bath.

2 Claims, 1 Drawing Sheet

SLAG WATER BATH PROCESS

BACKGROUND OF THE INVENTION

Conventional systems for quenching molten slag from a coal gasification reactor typically include a slag chamber having a bottom outlet for discharging molten slag which drops to the bottom of the slag chamber. Effectively facilitating separation and removal of the slag from the water bath is desirable to avoid buildup of slag in the water bath.

The present invention is directed to overcoming this problem.

Applicants are not aware of any prior art which, in their judgment as persons skilled in this particular art, would anticipate or render obvious the present invention. However, for the purpose of fully developing the background of the invention, and establishing the state of requisite art, the following art is set forth: U.S. Pat. Nos. 4,343,625; 4,377,394; 3,253,906; 4,073,629; 4,514,191; 4,328,006; 4,195,978; 4,289,502; 4,177,042; 4,487,612; 4,192,654; 4,126,427; 4,465,496; 4,472,171; 4,129,422; 4,119,411; 4,073,627 and 4,541,840.

SUMMARY OF THE INVENTION

The primary purpose of the present invention relates to slag being discharged downwardly from a slag tap of a coal gasification reactor into a slag water bath having a discharge opening from which slag is removed.

Preferably, such an apparatus includes means for converging the flow of the slag within a chamber at least partially submerged in the slag water bath and having a discharge port spaced above and aligned with the discharge opening of the slag water bath, the diameter of the means for converging the flow of the slag within the chamber being no greater than the diameter of the discharge opening of the slag water bath, and means for passing the flow of slag from the chamber to the discharge opening including means for withdrawing water from between the discharge port of the chamber and the discharge opening of the slag water bath.

Preferably, such a method includes converging the flow of the slag within a chamber at least partially submerged in the slag water bath and having a discharge port spaced above and aligned with the discharge opening of the slag water bath, the flow of slag being converged to a diameter no greater than the diameter of the discharge opening of the slag water bath, and passing the flow of slag from the chamber to the discharge opening while withdrawing water from between the discharge port of the chamber and the discharge opening of the slag water bath.

The various features of novelty which characterize the invention are pointed out with particularity in the claims forming a part of this disclosure. For a better understanding of this invention, its operating advantages and specific object obtained by its uses, reference may be made to the accompanying drawings and descriptive matter in which there are illustrated preferred embodiments of the invention.

DESCRIPTION OF A PREFERRED EMBODIMENT

Figure 1:
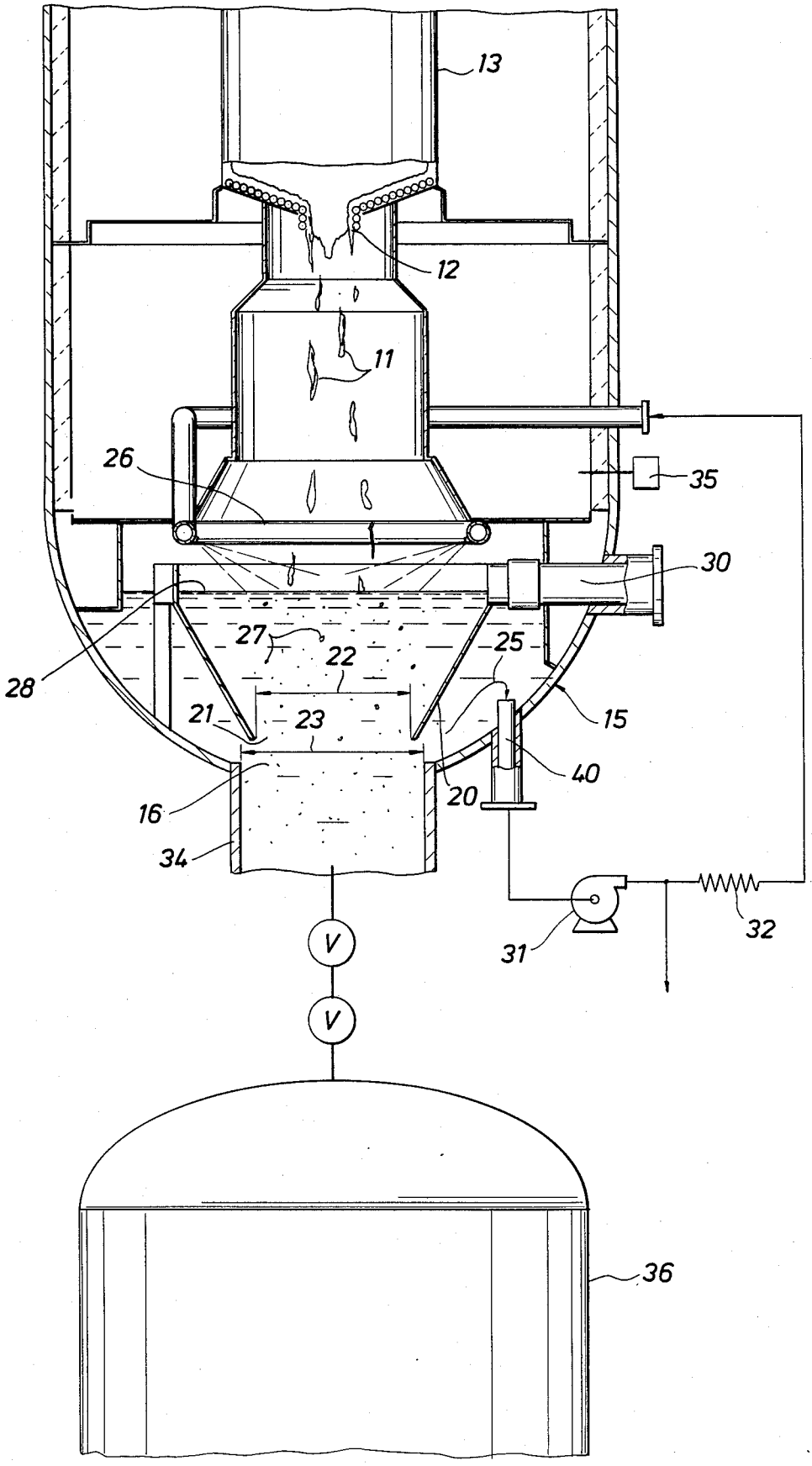
FIG. 1 illustrates a preferred embodiment of the present invention.

Generation of synthesis gas occurs by partially combusting carbonaceous fuel, such as coal, at relatively high temperatures in the range of 800°-2000° C. and at a pressure range of from about 1-200 bar in the presence of oxygen or oxygen-containing gases in a gasifier. Steam, carbon monoxide, carbon dioxide and oxygen-containing gases including air, oxygen-enriched air, and oxygen are optionally diluted with nitrogen and/or other inert gases.

The combustion may be complete or partial, the object of the combustion process being in the first case the production of heat, for example, for direct or indirect power generation and in the second case, the production of synthesis gas mainly consisting of carbon monoxide and hydrogen.

In the present invention, the ash, which is the inorganic, incombustible material, is separated from the fuel during the combustion of the fuel. Depending on the operating conditions under which combustion takes place, in particular the temperature and the quality of the fuel, the ash is mainly obtained in solid or liquid condition or in a combination thereof. The larger part of the liquid ash obtained, further referred to as slag, flows along the gasifier wall, through a discharge opening, often referred to as a slag tap, and is generally collected in a water bath located below the slag tap of the reactor, where the slag is cooled, solidified, and subsequently discharged.

The present invention relates to separating slag from water in a water bath having a chamber at least partially submerged in the slag water bath. The slag flows downwardly within the chamber and converges to a diameter no greater than the diameter of the discharge opening of the slag water bath. The slag may be wetted with water and/or a coagulating agent to assist the slag in sinking to the discharge port of the chamber.

Furthermore, water discharged from the water bath is recycled to an inlet opening of the water bath to maintain a level in the water bath. Additionally, water from slag sluicing vessels located below the slag water bath inject water into the slag water bath in a direction countercurrent to the downwardly-directed flow of the slag in the water bath. The temperature of the water bath is controlled to avoid cooling of the slag tap which could cause the slag tap to become blocked.

An advantage of the present invention is effective removal of slag and other solids, such as char, from the slag water bath by converging the flow using a chamber located within the slag water bath.

An additional advantage of the present invention is controlling the temperature of the water bath to avoid cooling of the slag tap.

Although the invention is described hereinafter primarily with reference to particulate coal, the method and apparatus according to the invention are also suitable for other catalytic or finely divided particulate reactive solids such as those which can be combusted as, for example, lignite, anthracite, bituminous brown coal, soot, petroleum coke, and the like. Preferably, the size of the solid carbonaceous fuel is such that about 90 percent by weight of the fuel has a particle size smaller than 100 mesh (A.S.T.M.).

Having thus generally described the apparatus and method of the present invention, as well as its numerous advantages over the art, the following is a more detailed description thereof, given in accordance with specific reference to the drawings. However, the drawings are of the process flow type in which auxiliary equipment, such as pumps, compressors, cleaning devices, etc. are not shown. All values are merely exemplary or calculated.

Referring to FIG. 1 of the drawing, an apparatus for separating slag from water illustrates slag 11 being discharged downwardly from a slag tap 12 of a coal gasification reactor 13 into a slag water bath 15. Hot molten slag is quenched in the slag bath 15. Upon quenching, the slag hardens to a glass-like apearance and is fractured to gravel-sized particles.

The converging flow of the slag within a chamber 20 at least partially submerged in the slag water bath 15 has a discharge port 21 spaced above and aligned with the discharge opening 16 of the slag water bath 15. The angle of the sides of the chamber 20 should be such that no slag will rest or accumulate on the sides. Also, if a lump of slag is large and if it is not yet sufficiently cooled when this surface is contacted, the lump will be enveloped by a cushion of steam which will prevent sticking of slag on the surface of the chamber 20. The flow of the slag is converged to a diameter 22 no greater than the diameter 23 of the discharge opening 16 of the slag water bath.

The flow of slag is passed from the chamber 20 to the discharge opening 16 of the slag water while withdrawing water 25 from between the discharge port 21 of the chamber 20 and the discharge opening 16 of the slag bath 15 and into pipe 40 at an elevation above the discharge opening 16 of the slag bath 15. The water 25 is withdrawn at a sufficiently low velocity so as not to entrain slag in the recycled water 25. The water 25 is recycled back to the water bath, preferably via a pump 31 and heat exchanger 32 prior to routing the water to a header 26 which is described in further detail below.

The circular header 26 located above the water bath 15 and provided with replaceable nozzles can be used for wetting the slag to facilitate removal of the slag from the water bath.

Floating slag 27 can be decanted from the water surface 28 of the chamber 20 via conduit 30.

The level of water in the slag water bath 15 is controlled using a level indicator controller 35 in communication with a differential pressure transmitter (not shown) or in any other manner well known to the art. Controlling the water level in the slag water bath 15 is necessary to prevent overfilling or emptying of the slag bath. If the water level falls below the intake line for the recycle pump 31, then process gases such as carbon monoxide, hydrogen, and hydrogen sulfide could leak through the pumps and eventually into the atmosphere. Too high a water level could lead to excessive water vaporization or cooling of the slag tap resulting in blockage of the slag tap.

Water is injected from a slag sluicing vessel 36, such as a lockhopper, located below the slag water bath 15 and in fluid communication therewith. The water flow from vessel 36 is counter-current to the downwardly-directed flow of the slag in the water bath 15. The level controller 35 regulates the water injected from the vessel 36 into the water bath 15.

The foregoing description of the invention is merely intended to be explanatory thereof, and various changes in the details of the described method and apparatus may be made within the scope of the appended claims without departing from the spirit of the invention.

What is claimed is:

1. A method for separating slag from water, said slag being discharged downwardly from a slag tag of a coal gasification reactor into a slag water bath having a discharge opening from which slag is downwardly removed, comprising the steps of:

directing the flow of said slag to a chamber which is at least partially submerged below the surface of said slag water bath, said chamber having converging walls which form a discharge port spaced above and aligned with the discharge opening of said slag water bath, said discharge port having a diameter no greater than the diameter of the discharge opening of said slag water bath;

wetting and entraining said slag within said chamber with at least one fluid causing said slag to sink towards said discharge port of said chamber;

converging the flow of slag by means of said converging chamber to said discharge opening of said slag water bath;

withdrawing water from a point within said slag water bath but outside said chamber and above the discharge opening of the slag water bath; and recycling said withdrawn water to an inlet opening of said water bath.

2. The method of claim 1 further including the step of decanting floating slag from the water surface of said chamber.

* * * * *